US010993512B2

(12) United States Patent
Rochat

(10) Patent No.: US 10,993,512 B2
(45) Date of Patent: May 4, 2021

(54) DEVICE FOR ATTACHING A BRACELET

(71) Applicant: Montres Breguet S.A., L'Abbaye (CH)

(72) Inventor: Fabrice Rochat, Vallorbe (CH)

(73) Assignee: Montres Breguet S.A., L'Abbaye (CH)

( * ) Notice: Subject to any disclaimer, the term of this patent is extended or adjusted under 35 U.S.C. 154(b) by 321 days.

(21) Appl. No.: 16/137,982

(22) Filed: Sep. 21, 2018

(65) Prior Publication Data

US 2019/0116945 A1 Apr. 25, 2019

(30) Foreign Application Priority Data

Oct. 20, 2017 (EP) ..... 17197443

(51) Int. Cl.
*A44C 5/14* (2006.01)
*G04B 37/14* (2006.01)

(52) U.S. Cl.
CPC ..... *A44C 5/147* (2013.01); *G04B 37/1486* (2013.01); *G04B 37/1493* (2013.01)

(58) Field of Classification Search
CPC ..... G04B 37/1486; G04B 37/1493; G04B 37/16; A44C 5/14; A44C 5/147; A44C 5/2052; A44C 5/10
See application file for complete search history.

(56) References Cited

U.S. PATENT DOCUMENTS 6,014,793 A 1/2000 Howald
7,249,398 B2 * 7/2007 Roy ..... A44C 5/147 24/265 B
10,219,591 B2 * 3/2019 Hatanaka ..... G04B 37/1486
2011/0197400 A1 8/2011 Chevrolet

FOREIGN PATENT DOCUMENTS

| | | |
|---|---|---|
| CH | 327838 | 2/1958 |
| DE | 20 2010 013 569 U1 | 2/2011 |
| EP | 0 682 300 A1 | 11/1995 |
| EP | 3 213 654 A1 | 9/2017 |
| FR | 2 742 638 A1 | 6/1997 |

(Continued)

OTHER PUBLICATIONS

European Search Report dated Apr. 16, 2018 in European application 17197443.9, filed on Oct. 20, 2017 (with English Translation of categories cited).

(Continued)

*Primary Examiner* — Edwin A. Leon
(74) *Attorney, Agent, or Firm* — Oblon, McClelland, Maier & Neustadt, L.L.P.

(57) ABSTRACT

A device for attaching a bracelet or strap to a watch case includes at least one horn integral with the watch case, and an insert integral with the end of a bracelet strand. The horn and the insert are complementary to cooperate by interlocking with each other to form a removable assembly able to make the bracelet interchangeable. The insert includes at least one stud subjected to the action of a spring, at least one stud being arranged to cooperate with at least one housing in the horn, the horn including a control member projecting radially with respect to the horn, in order to move the stud from a deployed position in which the stud holds the strand on the horn, to a retracted position in which the strand is released from the horn.

18 Claims, 3 Drawing Sheets

(56) References Cited

FOREIGN PATENT DOCUMENTS

| | | | | | |
|---|---|---|---|---|---|
| GB | 2297236 | A | * | 7/1996 | ..... A44C 5/2052 |
| JP | 7-303506 | A | | 11/1995 | |
| JP | 2015112442 | A | * | 6/2015 | |

OTHER PUBLICATIONS

Combined Chinese Office Action and Search Report dated Dec. 17, 2020 in Chinese Patent Application No. 201811213236.8 (with English translation of Categories of Cited Documents), citing documents AO and AP therein, 6 pages.

* cited by examiner

DEVICE FOR ATTACHING A BRACELET

This application claims priority from European patent application No. 17197443.9 filed on Oct. 20, 2017 the entire disclosure of which is hereby incorporated herein by reference.

FIELD OF THE INVENTION

The present invention relates to the field of horology or jewellery. More specifically, it concerns a method for attaching a strap or bracelet to an object, particularly a watch case.

BACKGROUND OF THE INVENTION

Generally, straps or bracelets, made of leather or metal, are attached to the horns of a watch case by means of a bar formed of a tube, inside which are mounted two pistons that move in translation, and an elastic member disposed between said pistons and intended to drive them outwardly of the tube. Said bar is mounted inside a housing provided for this purpose at one end of the bracelet, and the pistons are engaged in blind bores made opposite them in the horns of the case.

To detach a strap or bracelet attached to a case in this manner, it is necessary to have a tool designed to push the pistons back inside the tube, against the force exerted by the elastic member, and thereby remove them from the bores. The wearer of the watch does not permanently carry such a tool, and moreover, the tool can be inconvenient to use. This is why bracelets provided with such an attachment device are generally permanently secured to the case.

There are also attachment devices that allow the bracelet to be removed from the case without using a tool. Such devices usually comprise a bar, of the type described above, on which is mounted, through the tube, a member for actuating the pistons. Said actuation member is, for example, a radial finger integral with one of the pistons, as described in Swiss Patent No CH327838. The finger is slidably mounted through an axial slot made in the tube, and its movement along the slot pushes one of the pistons inside the tube.

CH Patent No. 614589 discloses a watch case with a device for attaching a strap to the case, the central horn has a cylindrical passage that is slit longitudinally over the entire length of the horn, to allow insertion of a bar for attaching a strap. The bar takes the form of a cylinder with a flat portion along its entire length to allow the bar to pass when it is inserted into the passage and to hold the bar in place when the latter occupies a determined angular position.

The attachment devices thus described are generally employed for interchangeable bracelets or straps which the user can then change as desired. They are not, however, free of drawbacks. It will be noted in particular, that they require major structural modifications to the bar, such as, for example, making an opening in the tube, or transforming the pistons. These changes entail significant extra manufacturing costs. These attachment devices also include a protruding element, namely the actuating member, which may snag or injure the wearer of the watch.

SUMMARY OF THE INVENTION

It is an object of the present invention to overcome these drawbacks by proposing a device for attaching a bracelet or strap to a watch case which does not have a bar, and which is easy to handle. The device comprises, on the one hand, at least one horn integral with the watch case, and on the other hand, an insert integral with the end of a bracelet strand, wherein the bar and the insert are complementary to cooperate by interlocking with each other to form removable assembly means able to make the bracelet interchangeable.

According to the invention, the insert includes at least one stud subjected to the action of elastic return means, said at least one stud being arranged to cooperate with at least one housing in the horn, the horn including a control member projecting radially with respect to the horn, in order to move the stud from a deployed position in which the stud holds the strand on the horn, to a retracted position in which the strand is released from the horn.

According to other advantageous variants of the invention:

- the control member is slidably mounted at one of the ends of said horn, said control member moving into said horn housing.
- the insert includes a cavity inside which the elastic return means and the stud rest successively
- the insert includes a pin integral therewith, said pin projecting into said cavity and being arranged to cooperate with a groove in said stud
- said horn includes means for centring the insert on said horn, said centring means being arranged to cooperate with a hole formed in the insert
- said at least one stud has an inclined plane
- the device includes at least one ring integral with the horn, said ring receiving said at least one control member
- said bracelet strand is a strand made of textile material, leather, synthetic material, plastic material
- said bracelet strand takes the form a multitude of links made of metallic, ceramic or composite material.

BRIEF DESCRIPTION OF THE DRAWINGS

Other features and advantages of the present invention will appear more dearly from the following detailed description of an example embodiment of a device for attaching a strap or bracelet according to the invention, this example being given solely by way of non-limiting illustration with reference to the annexed drawing, in which.

DETAILED DESCRIPTION OF PREFERRED EMBODIMENTS

Figure 1:
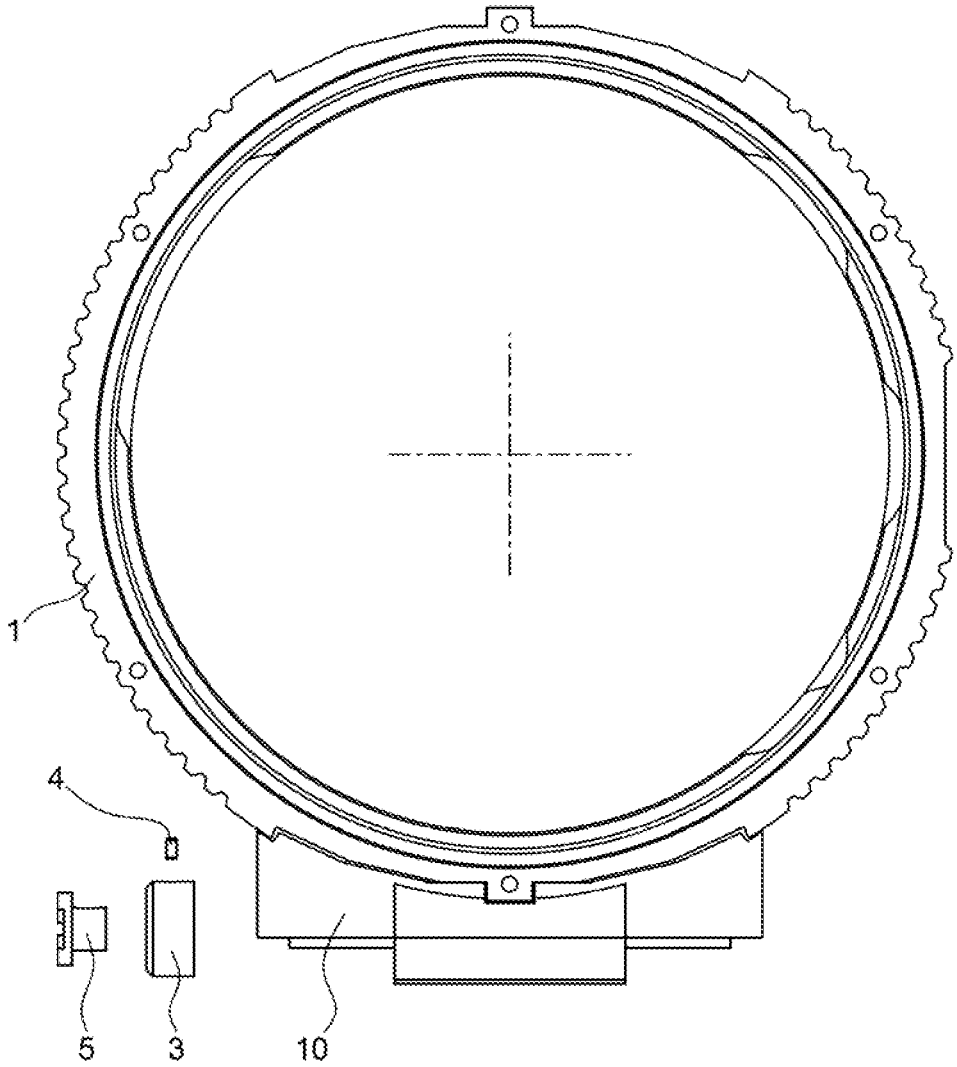
FIG. 1 illustrates a top view of a watch case provided with an attachment device according to the invention.
Figure 1:
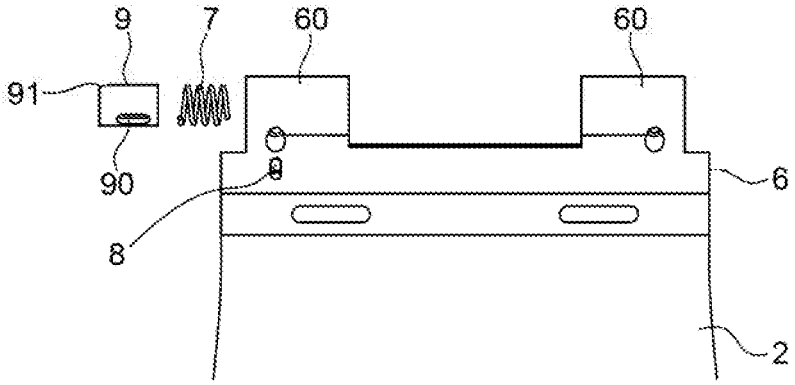

FIGS. 1 to 4 illustrate a wristwatch and detailed views of the device for attaching a bracelet to a watch case 1 according to a preferred embodiment of the invention. The attachment device includes, on the one hand, at least one horn 10 integral with watch case 1, and on the other hand an insert 6 integral with the end of bracelet strand 2, horn 10 and insert 6 being complementary in order to cooperate by interlocking with each other to form removable assembly means able to make the bracelet interchangeable.

According to the invention, insert 6 includes at least one stud 9 subjected to the action of elastic return means, said at least one stud 9 being arranged to cooperate with at least one housing in horn 10, the horn including a control member 5 projecting radially with respect to horn 10, in order to move the stud from a deployed position in which the stud holds the strand on the horn, to a retracted position in which the strand is released from the horn.

As illustrated in FIG. 1, watch case 1 includes a median horn 10 comprising at least one housing 100 arranged to receive all or part of the bracelet strand insert. Median horn 10 is integral with watch case 1 and includes at each of its ends a ring 3 receiving a control member, such as a pusher 5 for example, which is arranged to move axially in ring 3. Pusher 5 is limited in its travel and in rotation by a pin 4 which is pressed into ring 3 which is integral with the median horn. This arrangement allows pushers 5 to be accessed easily and quickly when the bracelet is changed.

As can be seen in FIG. 1, pusher 5 is slidably mounted in ring 3 and is arranged to move into the housing when the user presses said pusher. Each ring 3 is mounted at one end of the horn, the rings preferably having a cylindrical shape here, and horn 10 having a corresponding hollow cylindrical shape in watch case 1 for partially housing each ring 3 therein.

Figure 4:
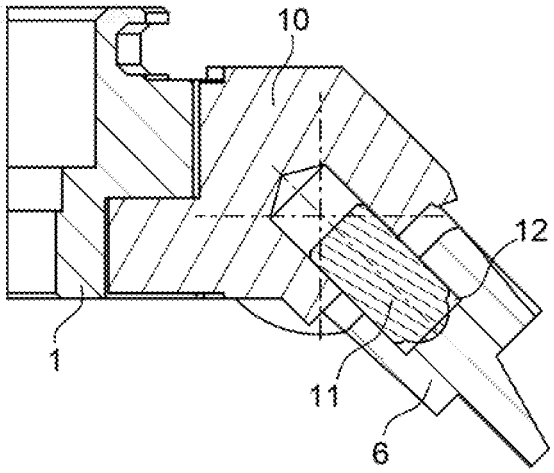
FIG. 4 illustrates a cross-sectional view of the means for centring the attachment device according to the invention when the bracelet is locked.

Advantageously, the watch case includes means for centring and/or guiding the insert on the watch case. As represented in FIGS. 1 and 4, these centring means take the form of a pair of ball catches 11, each ball catch 11 being arranged to cooperate with a first pair of holes 12 formed on the edge of insert 6. The respective size and depth of holes 12 and ball catches 11 are configured such that the insert no longer has any degree of freedom when ball catches 11 are engaged in holes 12 of insert 6.

Ball catches 11 are oriented downwards at an angle of 45° order to properly position the bracelet once the latter is assembled to watch case 1.

According to the invention, median horn 10 has at least one substantially rectangular opening 101 leading into a housing 100 for receiving insert 6, the height and the length of the opening corresponding to the height and the length of the insert. As represented, insert 6 includes two projecting portions 60 arranged to rest in two housings in the median horn. Those skilled in the art could also envisage having only one housing receiving the insert.

Figure 2:
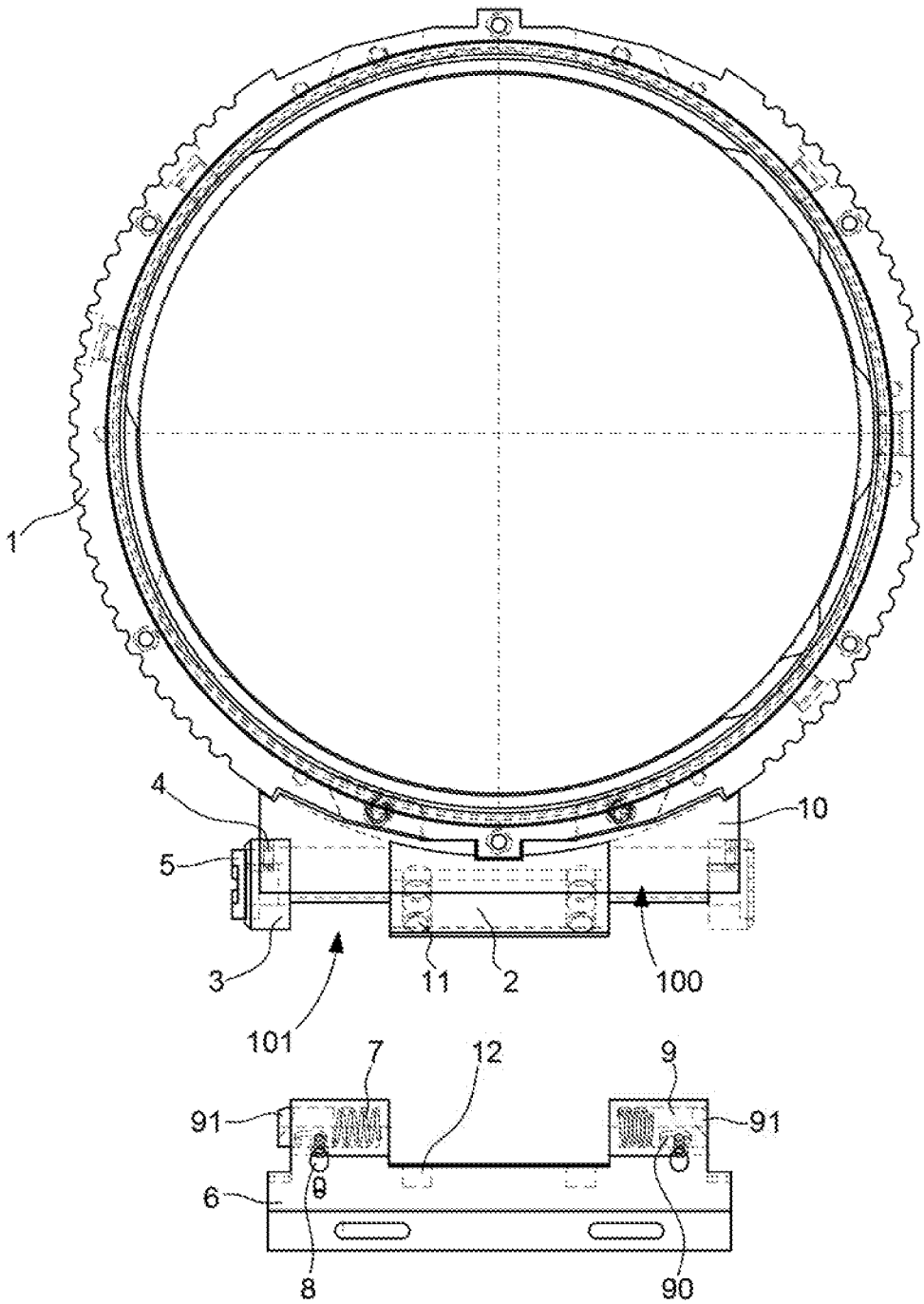
FIG. 2 illustrates a cross-sectional view taken along the median plane of the watch case and its bracelet before assembly thereof.
Figure 3:
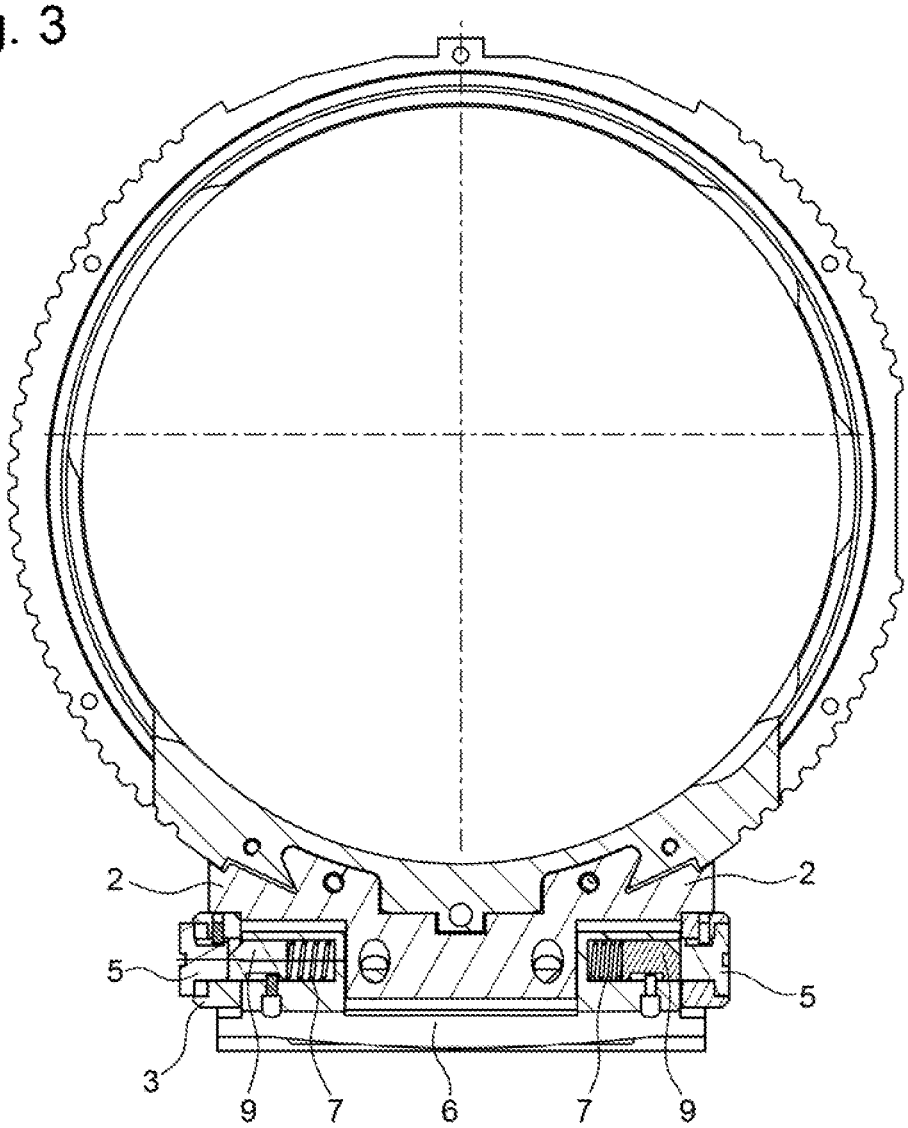
FIG. 3 illustrates a cross-sectional view taken along the median plane of the watch case with its bracelet in place.

As can be observed in FIGS. 2 and 3, insert 6 includes at least one circular cavity inside which rest successively elastic return means 7 and a stud 9 having a cylindrical cross-section, elastic return means 7 taking the form of a spiral spring for example.

Insert 6 also includes a pin 8 pressed therein; pin 6 projects into the cavity and is arranged to cooperate with a groove 90 formed on the stud in order to limit its travel and to lock it in rotation inside the cavity.

Advantageously, stud 9 has an inclined plane 91 on its projecting portion to facilitate the insertion of insert 6 into housing 100 of horn 10.

To secure the insert of bracelet strand 2 to case 1, as illustrated in FIGS. 3 and 4, the wearer pushes insert 6 into horn 10, by placing projecting portions 60 opposite openings 101 while allowing the insert to be guided/centred by means of ball catches 11. The inclined plane 91 of studs 9 allows said studs to enter housings 100 through the contact of the ring, with springs 7 being compressed at that moment.

When insert 6 reaches the bottom of housing 100, stud 9 returns to its rest position, which will have the effect of relaxing spring 7 and exerting a force that will move pusher 5 out of ring 3. At that instant, bracelet strand 2 can no longer be detached from the horn, since studs 9 are held inside housings 100 and ball catches 11 are resting inside holes 12 of insert 6.

In order to detach bracelet strand 2 from horn 1, the wearer must simultaneously press on pushers 5, each pusher then acting on a stud 9 and compressing springs 7, and then pull bracelet strand 2 to remove the insert from housings 100 of horn 10.

In the embodiment described above, the insert is disposed on a bracelet or strap made of leather, synthetic fabric, plastic, metal, ceramic or composite material. Likewise, bar 4 is preferably made of metal but could also be made of plastic ceramic or composite material.

Those skilled in the art could also implement the same attachment device for a bracelet strand with links, in which case the connecting link to watch case 1 receives insert 6 and the links could also be made of metallic, ceramic or composite material.

As a result of these various aspects of the invention, there is provided a secure bracelet attachment device which allows the bracelet to be changed quickly and easily, while dispensing with the bar that conventionally holds the bracelet strand on the watch case.

Of course, this invention is not limited to the illustrated example and is capable of various variants and modifications that will appear to those skilled in the art. Those skilled in the art would have no difficulty, for example, in switching the position of studs 9 and pushers 5. Thus, in such an embodiment, the bracelet receives pushers 5 in lateral edges, in proximity to insert 6, and pusher 5 is slidably mounted in ring 3 integral with the insert. Each ring 3 is mounted at one end of the insert, the rings preferably taking a cylindrical shape here. The horn includes a circular cavity at each of its lateral ends, each cavity successively receiving elastic return means 7 and a projecting stud 9 for cooperating with pushers 5. The user then simply needs to press on the pushers and push or pull the bracelet strand in order respectively to assemble or disassemble said strand.

What is claimed is:

1. A device for attaching a bracelet or strap to a watch case, comprising:

at least one horn integral with the watch case;

an insert integral with an end of a bracelet strand, the horn and the insert being complementary in order to cooperate by interlocking with each other to form a removable assembly configured to make the bracelet strand interchangeable; and an engagement portion configured to restrict rotational movement of the insert about the horn, wherein the insert includes at least one stud subjected to an action of an elastic return means, the at least one stud is arranged to cooperate with at least one housing in the horn, the horn includes a control member projecting radially with respect to the horn, and the control member is configured to move the stud from a deployed position in which the stud holds the bracelet strand on the horn to a retracted position in which the bracelet strand is released from the horn.

2. The device according to claim 1, wherein the control member is slidably mounted at one of ends of the horn, the control member moving into the housing of the horn.

3. The device according to claim 1, wherein the insert includes at least one cavity inside which the elastic return means and the stud rest successively.

4. The device according to claim 3, wherein the insert includes a pin integral therewith, the pin projecting into the cavity and being arranged to cooperate with a groove of the stud.

5. The device according to claim 1, wherein the horn includes the engagement portion, the engagement portion centers the insert on the horn, and the engagement portion is arranged to cooperate with at least one hole formed in the insert.

6. The device according to claim 1, wherein the at least one stud has an inclined plane.

7. The device according to claim 1, comprising at least one ring integral with the horn, wherein the ring receives the control member.

8. The device according to claim 1, wherein the bracelet strand is a strand made of one of a textile material, a leather, a synthetic material, and a plastic material.

9. The device according to claim 1, wherein the bracelet strand takes the form of a multitude of links made of one of a metallic, a ceramic, and a composite material.

10. A device for attaching a bracelet or strap to a watch case, comprising:

at least one horn integral with the watch case; and an insert integral with an end of a bracelet strand, the horn and the insert being complementary in order to cooperate by interlocking with each other to form a removable assembly configured to make the bracelet strand interchangeable, wherein the horn includes at least one stud subjected to an action of elastic return means, the at least one stud is arranged to cooperate with at least one housing in the insert, the insert includes a control member projecting radially with respect to the insert, and the control member is configured to move the stud from a deployed position in which the stud holds the bracelet strand on the horn to a retracted position in which the bracelet strand is released from the horn.

11. A timepiece comprising the device according to claim 1.

12. The device according to claim 1, wherein the insert includes two projection portions, and each projecting portion has one stud.

13. The device according to claim 1, wherein the engagement portion is configured to restrict the rotational movement of the insert with respect to the horn about an axis parallel to an axis extending transversely through a longest side of the horn.

14. The device according to claim 13, wherein the engagement portion is configured to restrict all degrees of freedom of the insert with respect to the horn.

15. The device according to claim 10, wherein the insert includes two projection portions, and each projecting portion has one stud.

16. The device according to claim 10, further comprising:

an engagement portion configured to restrict rotational movement of the insert about the horn.

17. The device according to claim 16, wherein the engagement portion is configured to restrict the rotational movement of the insert with respect to the horn about an axis parallel to an axis extending transversely through a longest side of the horn.

18. The device according to claim 17, wherein the engagement portion is configured to restrict all degrees of freedom of the insert with respect to the horn.

* * * * *